US009131785B2

(12) United States Patent
Peru

(10) Patent No.: US 9,131,785 B2
(45) Date of Patent: Sep. 15, 2015

(54) ORGANIZING UNIT

(71) Applicant: July L. Peru, Colorado Springs, CO (US)

(72) Inventor: July L. Peru, Colorado Springs, CO (US)

( * ) Notice: Subject to any disclaimer, the term of this patent is extended or adjusted under 35 U.S.C. 154(b) by 0 days.

(21) Appl. No.: 13/910,504

(22) Filed: Jun. 5, 2013

(65) Prior Publication Data

US 2013/0320830 A1 Dec. 5, 2013

Related U.S. Application Data

(60) Provisional application No. 61/655,840, filed on Jun. 5, 2012.

(51) Int. Cl.

| | |
|---|---|
| ***A47B 81/00*** | (2006.01) |
| ***A47F 1/04*** | (2006.01) |
| *B65F 1/06* | (2006.01) |
| *B65F 1/14* | (2006.01) |
| *B65F 1/16* | (2006.01) |

(52) U.S. Cl.

CPC ..... *A47F 1/04* (2013.01); *B65F 1/1415* (2013.01); *B65F 1/1426* (2013.01); *B65F 1/067* (2013.01); *B65F 1/1473* (2013.01); *B65F 2001/1676* (2013.01); *B65F 2210/129* (2013.01); *B65F 2210/148* (2013.01)

(58) Field of Classification Search

CPC ..... A47F 13/08; B65F 1/06; A47G 29/14; A47G 29/1201; A47G 29/1223; A47G 29/30

USPC ..... 312/270.1, 283; 211/10, 12; 248/99, 248/101; 232/25, 19, 24, 30, 31, 32, 43.2; 220/505, 524, 501, 553, 495.01, 23.88, 220/23.86, 23.83

See application file for complete search history.

(56) References Cited

U.S. PATENT DOCUMENTS

| | | | | |
|---|---|---|---|---|
| 2,429,673 | A * | 10/1947 | Davis | 193/34 |
| 2,636,800 | A | 4/1953 | Downey | |
| 3,421,689 | A | 1/1969 | Reinzan | |
| 4,664,455 | A | 5/1987 | Greenhow | |
| 4,834,262 | A | 5/1989 | Reed | |

(Continued)

FOREIGN PATENT DOCUMENTS

WO PCT/GB2003/004837 11/2003

OTHER PUBLICATIONS

International Search Report for International (PCT) Patent Application No. PCT/US13/44270, mailed Oct. 8, 2013, 3 pages.

*Primary Examiner* — Matthew Ing
*Assistant Examiner* — Andres F Gallego
(74) *Attorney, Agent, or Firm* — Aspire IP; Scott J. Hawranek

(57) ABSTRACT

An organizing unit is used with a plurality of pliable containers. Each pliable container has a mouth. The organizing unit has a housing, openings, and fasteners. The housing has an external surface, more than one side, and a common container compartment. The common container compartment is formed inside the housing for receiving the plurality of pliable containers. The openings are formed between the external surface of the housing and the common container compartment. At least one of the fasteners is disposed near each opening for removably affixing one of the pliable containers within each opening. The mouth of each pliable container is disposed adjacent one of the opening and each pliable container hangs within the common container compartment.

12 Claims, 4 Drawing Sheets

(56) References Cited

U.S. PATENT DOCUMENTS

| | | | | |
|---|---|---|---|---|
| 4,854,497 | A | | 8/1989 | Smith |
| 4,941,653 | A | | 7/1990 | Sterner, Jr. |
| 4,964,523 | A | | 10/1990 | Bieltvedt |
| 4,984,704 | A | | 1/1991 | O'Malley |
| 5,062,539 | A | | 11/1991 | Chandler |
| 5,090,587 | A | | 2/1992 | Brown |
| 5,101,997 | A | | 4/1992 | Bagwell et al. |
| 5,111,958 | A | | 5/1992 | Witthoeft |
| 5,203,618 | A | | 4/1993 | Oshall |
| 5,207,344 | A | | 5/1993 | Davies et al. |
| 5,238,301 | A | | 8/1993 | Brady |
| 5,242,220 | A | | 9/1993 | Sandreth |
| 5,259,514 | A | | 11/1993 | Falter et al. |
| 5,294,012 | A | | 3/1994 | Shott et al. |
| 5,310,078 | A | | 5/1994 | Strawder |
| 5,320,241 | A | | 6/1994 | Evans |
| 5,415,086 | A | | 5/1995 | Robbins |
| 5,417,338 | A | | 5/1995 | Roy et al. |
| 5,558,254 | A | | 9/1996 | Anderson et al. |
| D379,015 | S | | 4/1997 | Mayhew |
| 5,683,030 | A | | 11/1997 | Moore et al. |
| 5,695,114 | A | | 12/1997 | Evans |
| 5,740,923 | A | | 4/1998 | Mayhew |
| 5,878,904 | A | | 3/1999 | Schweigert |
| 6,047,843 | A | | 4/2000 | Mecke |
| D583,122 | S | * | 12/2008 | Ralph ..... D34/24 |
| 2003/0076013 | A1 | | 4/2003 | Kauzlarich et al. |
| 2008/0055849 | A1 | | 3/2008 | Lee |
| 2011/0026856 | A1 | | 2/2011 | Lopez-Araiza |
| 2012/0317922 | A1 | | 12/2012 | Chang |
| 2013/0069326 | A1 | | 3/2013 | Padgett et al. |

* cited by examiner

ORGANIZING UNIT

RELATED APPLICATIONS

This application claims the benefit of U.S. Provisional Application No. 61/655,840 filed Jun. 5, 2012.

BACKGROUND

As the practice of recycling becomes more commonplace, finding a satisfactory solution for storing different recyclable materials separately becomes more important. Traditionally, different recyclable materials have been sorted and stored in separate containers side by side. While convenient, this approach has a large footprint.

DETAILED DESCRIPTION

Figure 1:
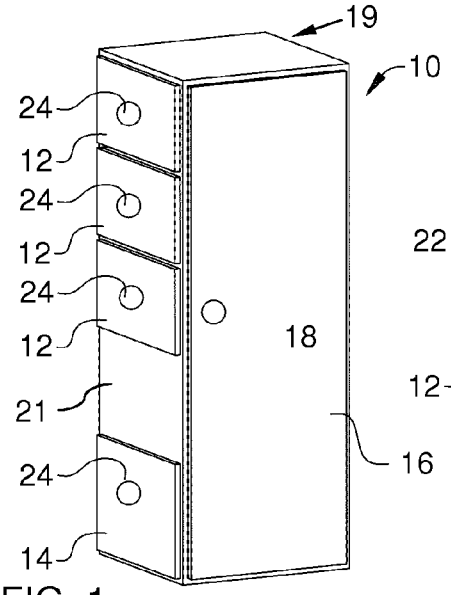
FIG. 1 is a perspective view of one embodiment of the present invention organizing unit.
Figure 2:
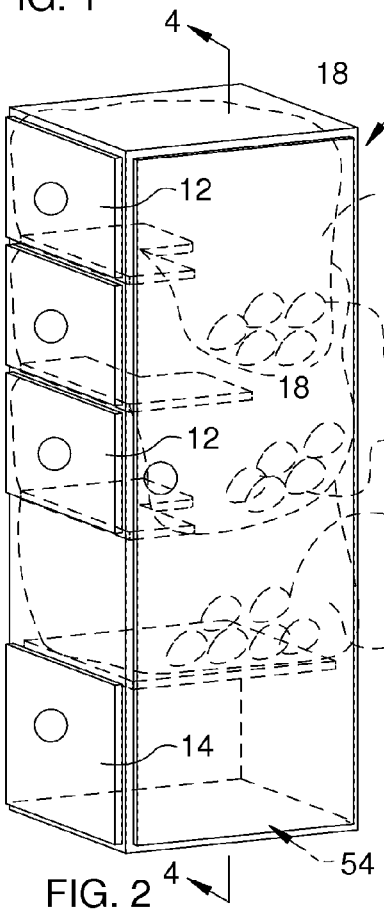
FIG. 2 is a perspective view of one embodiment of the present invention illustrating bag placement in within the organizing unit.
Figure 3:
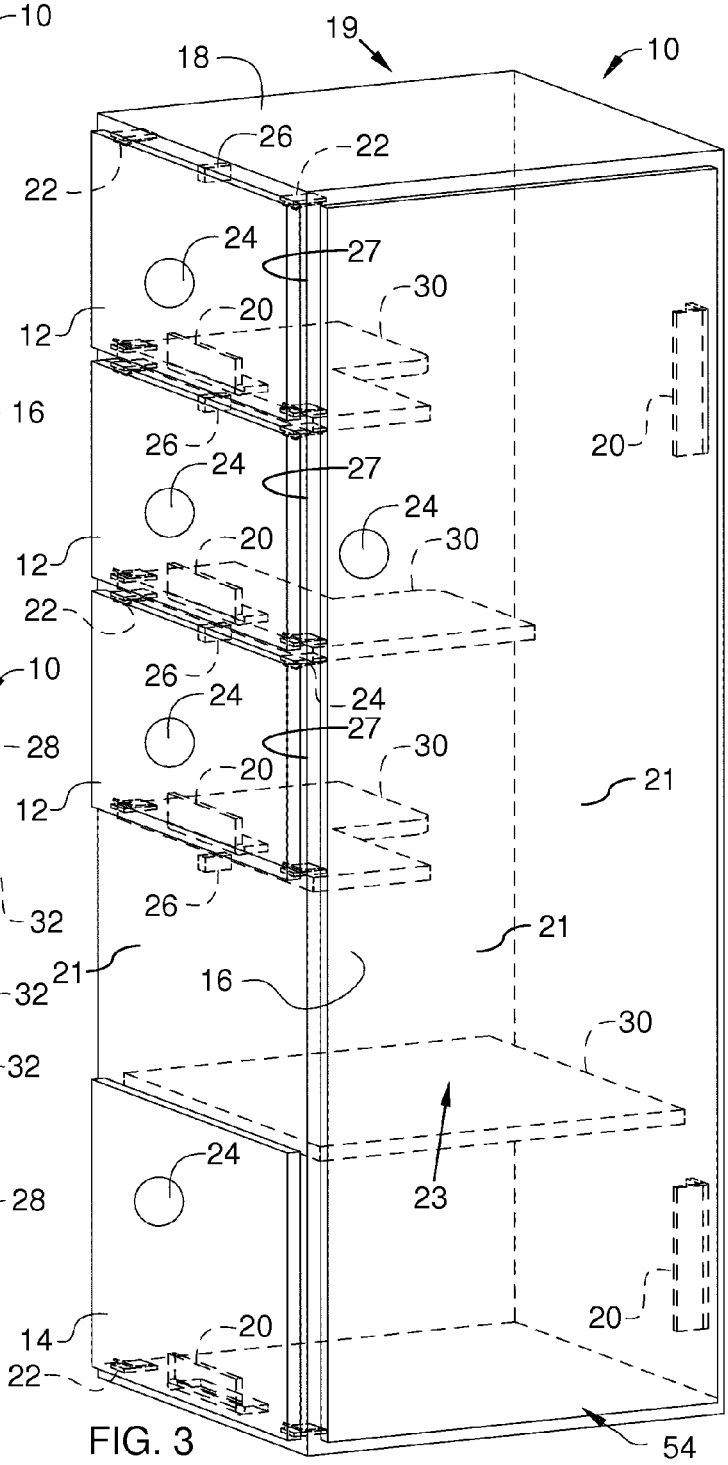
FIG. 3 is a perspective view of one embodiment of the present invention illustrating general hardware placement.
Figure 4:
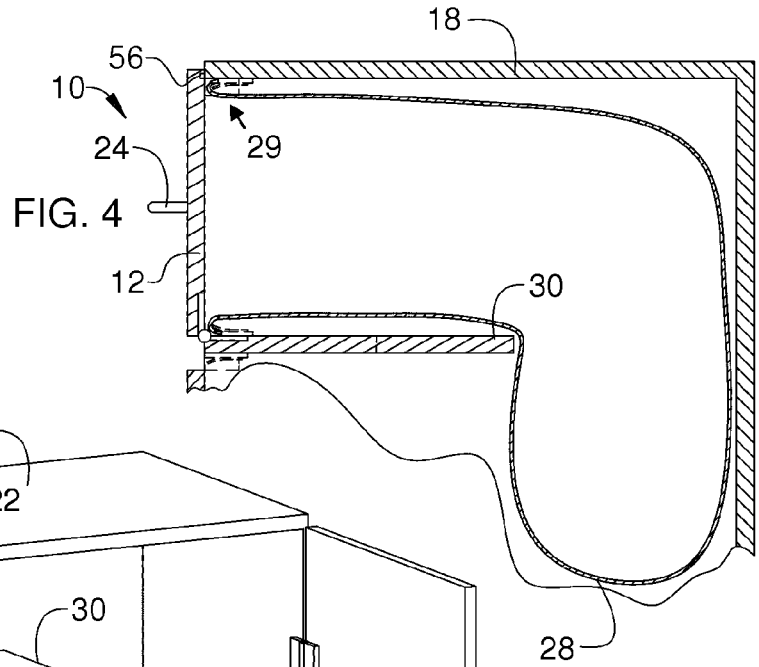
FIG. 4 is a section detail view of one embodiment of the present invention along line 4-4 in FIG. 2.
Figure 5:
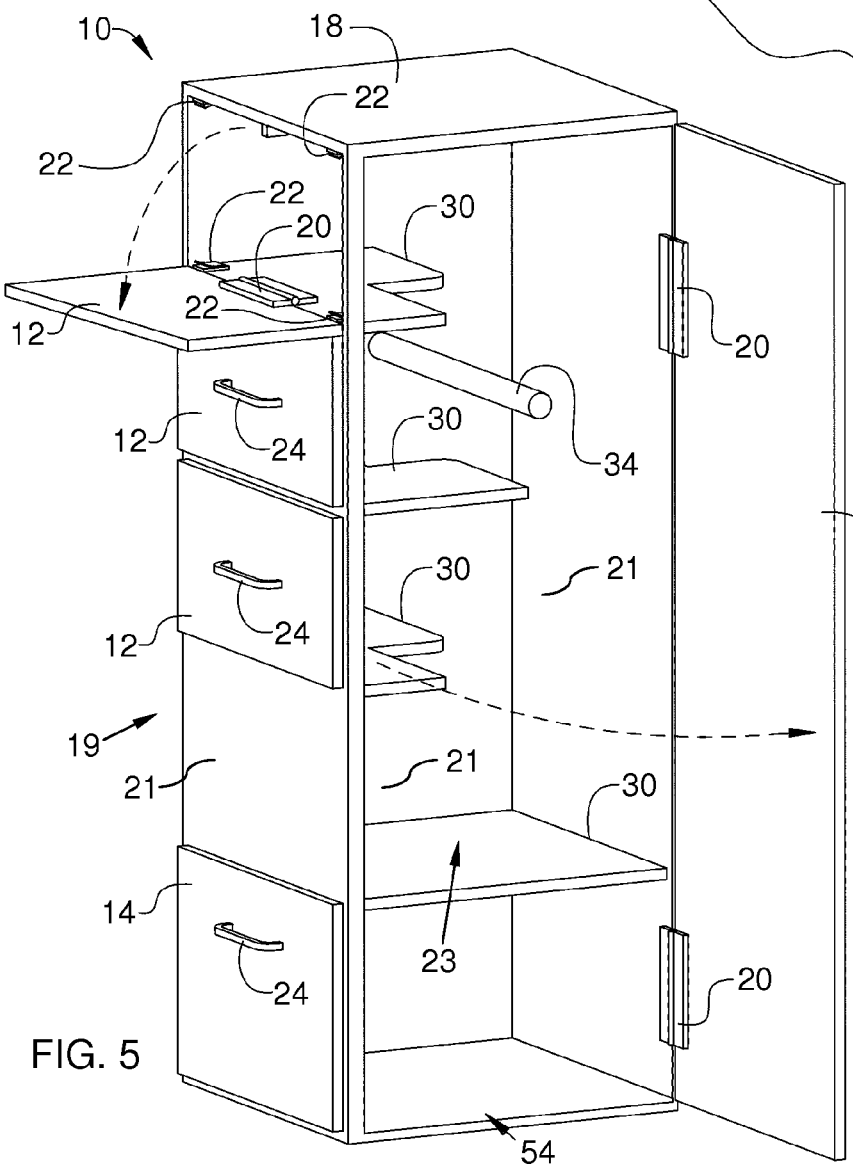
FIG. 5 is a perspective view of one embodiment of the present invention illustrating rotational motion of multiple components.

FIGS. 1-3 show the organizing unit 10 of the present invention. Organizing unit 10 has a housing (or body) 18 and fasteners (such as clamps) 22. Housing 18 has an external surface 21, sides 23, and a common container compartment 23. Common container compartment 23 receives a plurality of pliable containers (such as bags) 28. Each pliable container 28 has a mouth 29 for access to the inside of the pliable container 28.

Organizing unit 10 is useful for keeping different recycling materials separate, but organizing unit 10 and pliable containers 28 may also sort and store many items such as ingredients for food or drink production, clothes for storage or laundry, recyclable products for future disposal, toys, art supplies, implements or tools, etc. The pliable containers 28 and fasteners 22 could also be reinforced to handle commercial or industrial loads and heavier items.

Openings 27 are formed between external surface 19 of housing 18 and common container compartment 23. In one embodiment, each of the openings 27 is formed on one side 21 of housing 18. In one embodiment, the opening 27 are vertically aligned in housing 18.

Fasteners 22 are disposed near each opening 27 for removably affixing pliable containers 28 within opening 27 such that the mouth 29 of each pliable container 28 is disposed adjacent one of the opening 27 and each pliable container 28 hangs within common container compartment 23. In one embodiment, fasteners 22 are disposed to hold the mouth 29 of each pliable container 28 open in each opening 27. In one embodiment, there are four or more fasteners 22 around each opening 27. Fasteners 22 may be placed in different locations such as on the side of the opening 27.

In one embodiment, organizing unit 10 further includes at least one shelf (or chute) 30 extending from one of the openings 27 part way into common container compartment 23. Each shelf 30 is disposed to partially support a pliable container 28 near the mouth 29 of the supported pliable container 28. In one embodiment, each shelf 30 has a recess 31 formed therein along one side of the shelf 30, recess 31 is disposed to conduct pliable container 28 in the direction of recess 31 as shown in FIG. 2. Although illustrated as rectangular in shape, shelves 30 may have any general shape such as elliptical, curved, or otherwise.

In one embodiment, one side 21 of housing 18 is open for access to common container compartment 23 and the pliable containers 28 disposed therein. A door 16 is hingedly affixed to the open side 21 of housing 18. Instead of a side door 16, organizing unit 10 may have a back door for retrieving materials.

In one embodiment, organizing unit 10 has no side door 16 and is instead emptied out of a removable panel 58 from the top. The bottom compartment 54 would be emptied from the front of organizing unit 10 through its own door 14, with or without a crate (not shown).

In one embodiment, organizing unit 10 further includes at least one support bar 34. Each support bar 34 is disposed between two adjacent openings 27 and within common container compartment 23. A pliable container 28 disposed in the upper one of the two adjacent openings 27 is supported by support bar 34 preventing such pliable container 28 from collapsing a pliable container 28 disposed in the lower one of the two adjacent openings 27.

In practice, the present invention may be used as follows. To load organizing unit 10, a user opens each opening's small spring loaded front door 12, and affixes pliable containers 28 to fasteners 22. The spring load for front doors 12 is optional. Doors 12 themselves are optional in part or in their entirety.

Figure 9:
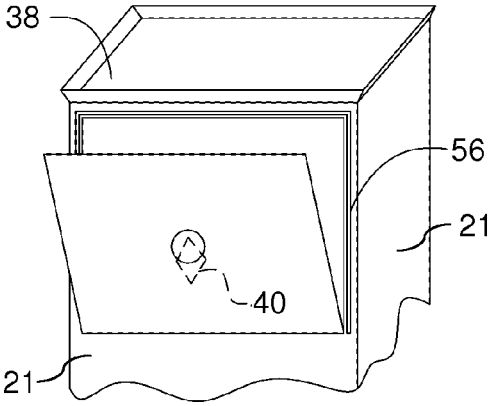
FIG. 9 is a perspective view of an alternate embodiment of the present invention showing an odor reducing product.

Each spring loaded front door 12 is held shut by a magnetic latch 26 at its top and a hinge 20 at its bottom. Doors 12, 14, 16 may utilize rubber seals 56 in order to help keep them airtight as shown in FIG. 9. The present invention could utilize any suitable door as known by those in the art, such as swinging doors commonly used in commercial settings and shown in FIG. 10.

In one embodiment, odor reducing products 40 may be affixed to the inside of doors 12 or other places in organizing unit 10 as shown in FIG. 9.

The user can put away various recyclable materials into the pliable containers 28. For example, plastic on the top, cans and foil in the middle and glass in the bottom. In one embodiment, the bottom pliable container 28 is supported by a floor at the top of large bottom compartment 54.

Each pliable container 28 may be filled with recyclables and the pliable containers 28 may be stuffed to capacity, yet they will not close with added bulk because each pliable container 28 is held open for the user by shelves 30 designed to hold pliable containers 28 open and beneath the pliable containers 28, in select places, are support bars 34 designed to hold pliable containers 28 open.

In one embodiment, at the base of organizing unit 10 is a large bottom compartment 54 which may not rely on shelves or fasteners 22 but rather the user drops recyclables through the door 14 directly into the bottom compartment 54 which may contain a crate for holding the materials. In this embodiment, the user may drop in flattened newspapers, magazines, and pizza boxes. Large bottom compartment 54 may utilize a ceiling which is the same board as the floor of common container compartment 23.

In one embodiment, when the user is ready to empty organizing unit 10, to retrieve the pliable containers 28, the user opens organizing unit 10 from side door 16 which also has a handle 24 and magnetic latch 26 which holds it firmly shut like the other doors 12. This large side door 16 runs vertical the length of organizing unit 10.

Once side door 16 is opened, the user can easily release each pliable container 28 by pressing the fasteners 22 around the mouth of the pliable containers. The user releases each pliable container 28 from its fasteners 22 at the front of organizing unit 10, and pulls each pliable container 28 out of organizing unit 10 from side door 16 for proper disposal.

Also large bottom compartment 54 is pulled out via side door 16 for proper disposal. Side door 16 with handle 24 and magnetic latch 26 is opened and closed by a means of sturdy hinges 20.

The elements of the present invention work together and individually by its design; it allows the inner space of organizing unit 10 to be utilized as much as the user wants to stuff materials into each pliable container 28, or into the bottom compartment 54. The components are individualized but work to organize materials together as organizing unit's ability to utilize more space and capacity allows the user to store materials out of sight for long periods of time before having to empty it. The larger capacity and upright design allows for longer periods of stuffing in materials.

The user affixes pliable containers 28 to the fasteners 22, then proceeds to fill the pliable containers 28 and bottom compartment 54, then empties organizing unit 10 by means of side door 16.

Figure 6:
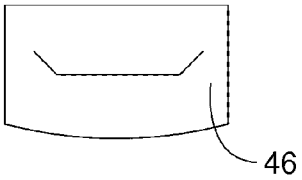
FIG. 6 is a perspective view of an alternate embodiment of a handle of the present invention.
Figure 7:
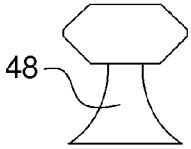
FIG. 7 is a perspective view of an alternate embodiment of a handle of the present invention.
Figure 8:
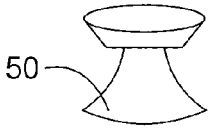
FIG. 8 is a perspective view of an alternate embodiment of a handle of the present invention.

Organizing unit 10 may utilize different types of handles, including pocket-like handles 46 or rounded handles 48, 50 as shown in FIGS. 6-8.

Organizing unit 10 may have additional accessories such as a can crusher on the side, tack hooks, or topside table, with or without accoutrements such as a beverage bar, or mini-fridge, etc., also a white board or tool hangers may be affixed to the side, etc. Organizing unit 10 may have an aesthetically pleasing, industrial, or other type of appearance.

Figure 10:
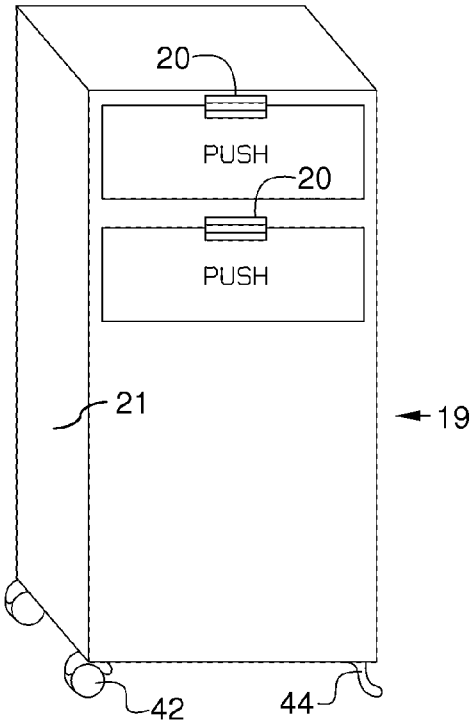
FIG. 10 is a perspective view of an alternate embodiment of the present invention illustrating a mobile public use version of the present invention.
Figure 11:
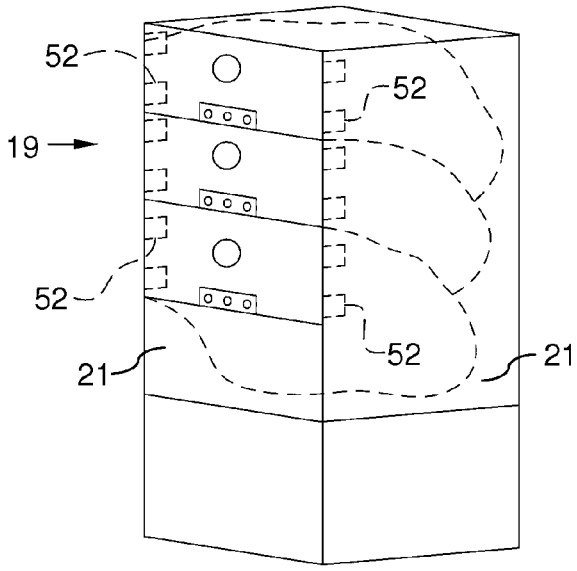
FIG. 11 is a perspective view of an alternate embodiment of the present invention illustrating the "no chute" option.
Figure 12:
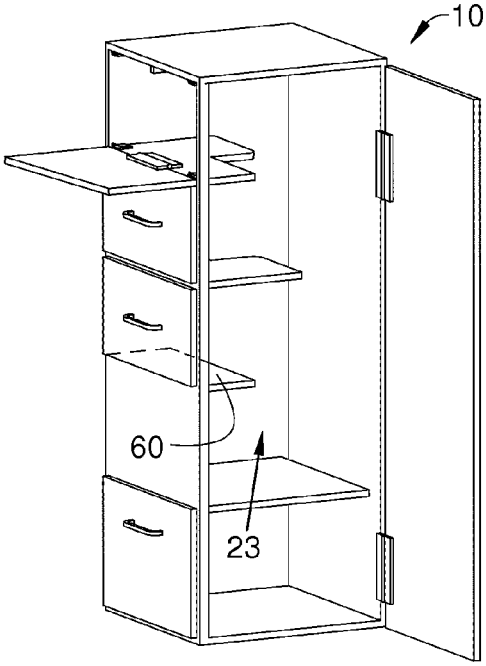
FIG. 12 is a perspective view of an alternate embodiment of the present invention illustrating the "shortened chute" option.
Figure 13:
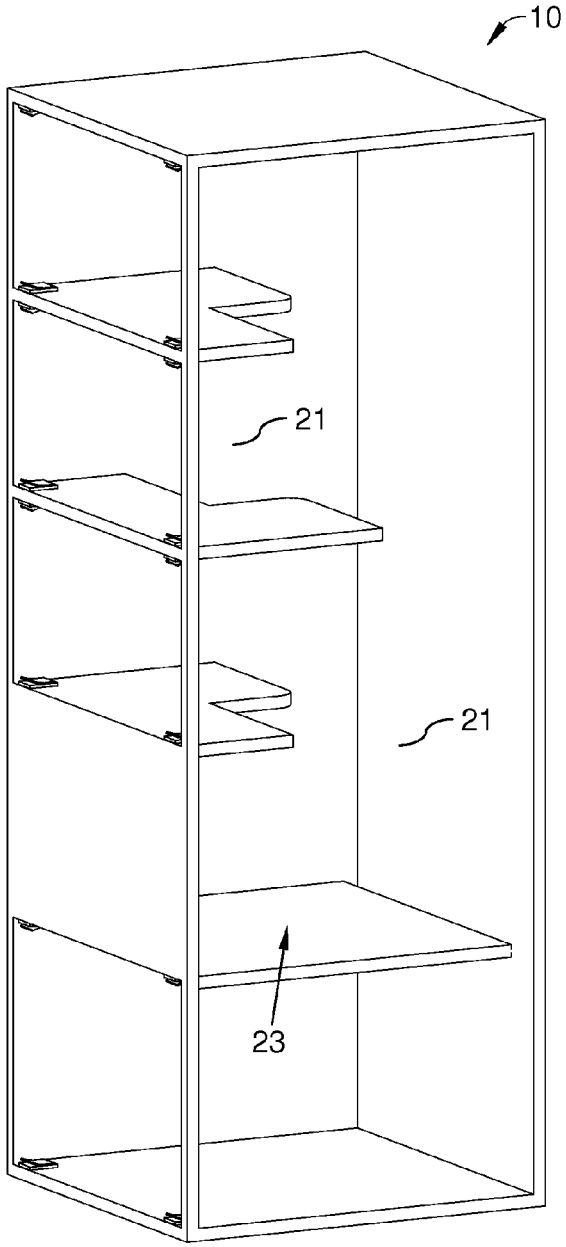
FIG. 13 is a perspective view of an alternate embodiment of the present invention illustrating the "no doors" option.
Figure 14:
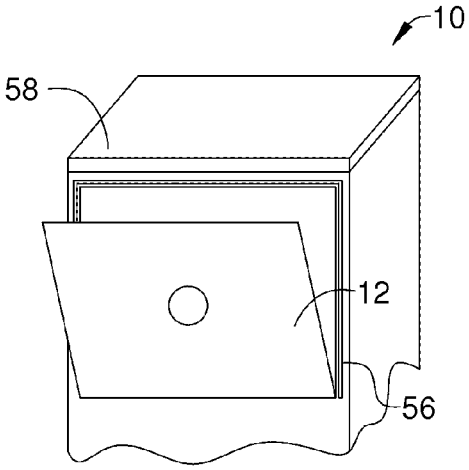
FIG. 14 is a perspective detail view of an alternate embodiment of the present invention illustrating the "removable top" option.

Organizing unit 10 could be a hanging unit of the same design, hanging from the ceiling instead of sitting on the floor. Further organizing unit 10 may sit on furniture feet 44 or wheels 42 as shown in FIG. 10. In addition, organizing unit 10 may be a built-in unit. Although pictured as rectangular, the shape of organizing unit 10 and housing 18 may be any suitable shape.

One example of constructing one embodiment of the present invention follows. Cut a free swinging side door 16 along the length of one side of organizing unit 10. Door 16 opens at the front of organizing unit 10, so the user facing organizing unit 10 can easily reach into side door 16. Cut several horizontal openings that are frame-like shelves 30, along the front of organizing unit 10, starting at the top. Affix another large frame without a shelf at the top of large bottom compartment 54. Place large crate into bottom compartment 54, the crate must be the right size to slide in and out of side door 16 for unloading. Along the front of organizing unit 10 apply spring loaded doors 14, each with a handle 24 and magnetic latch 26, to cover the openings 27. Affix fasteners 22 to each corner of the upper openings 27, no fasteners 22 are required for bottom compartment 54, because there is no pliable container 28. Shelves 30 and support bars 34 cause pliable containers 28 to stay open for the user.

The present invention utilizes the full capacity of pliable containers 28 as far as they may be filled because pliable containers 28 are hanging in free space within organizing unit 10. The present invention allows for maximum pliable container capacity to be utilized while using less space given its upright design, allowing for compactness.

Organizing unit 10 allows for easy recycling in home or office, industrial or commercial environments, and by having a vertical design it uses less space. The user disposes of recyclable waste products through several stacked pliable containers which hold the products until further disposal.

The present invention's design requires minimal space and its design, with pliable containers 28 sitting atop each, other allows for fuller capacity before pliable containers 28 are removed. The pliable containers 28 are held securely by fasteners 22, keeping them whole and fully intact while they are being stuffed with recyclables. The internal design causes pliable containers 28 to stay open enough to allow large objects to be inserted into each pliable containers 28 below and above regardless of pliable container capacity.

The present invention allows for maximum pliable container capacity to be used while keeping the pliable containers 28 securely positioned vertically. The pliable containers 28 lay on top of each other within organizing unit 10, allowing the user to stuff them to full capacity while organizing unit 10 itself occupies less space given its vertical design.

The foregoing description is only illustrative of one embodiment of the present invention. Various alternatives and modifications may be devised by those skilled in the art without departing from the present invention. Accordingly, the present invention embraces all such alternatives, modifications, and variances that fall within the scope of the appended claims.

What is claimed is:

1. An apparatus with a plurality of pliable containers, each pliable container having a mouth, the apparatus comprising: a base; a first side coupled to the base; a second side coupled to the base; a third side movably coupled to the second side configured to move from a first open position to a second closed position; a fourth side coupled to the base comprising a first door configured to move from a closed position to an open position thereby forming a first opening, a second door configured to move from a closed position to an open position thereby forming a second opening and a third door configured to move from a closed position to an open position thereby forming a third opening; wherein the first opening, the second opening, and the third opening are vertically aligned in the fourth side; a top coupled to the first side, the second side, the third side and the fourth side; a housing having an external surface, a plurality of sides, and a common container compartment formed between the first side, the second side, the third side and the fourth side and the top; a first shelf extending from the first opening part way into the common container compartment, the first shelf comprising a first recess; a second shelf extending from the second opening part way into the common container compartment, the second shelf comprising a second recess configured in a different geometric configuration as compared to the first recess; a third shelf extending from the third opening part way into the common container compartment, wherein one of the first opening, the second opening, or the third opening is configured to receive a mouth of one of the plurality of pliable containers such that the mouth of the one of the plurality of pliable containers is disposed adjacent the one of the openings and a portion of a body of the one of the plurality of pliable containers hangs together within the common container compartment; and further comprising at least one support bar, each support bar respectively positioned between two adjacent ones of the shelves and within the common container compartment, wherein the body of the one of the plurality of pliable containers on an upper of the two adjacent shelves is supported by the support bar.

2. The apparatus of claim 1, wherein the first opening, the second opening and the third opening are configured in a rectangular geometric configuration.

3. The apparatus of claim 1, further comprising a plurality of fasteners, at least one of the fasteners positioned near the one of the first opening, the second opening or the third opening for removably affixing the one of the plurality of pliable containers such that the mouth of the one of the plurality of pliable containers is positioned adjacent to the one of the first opening, the second opening or the third opening, and wherein the fasteners are positioned to hold the mouth of the one of the plurality of pliable containers at least partially open.

4. The apparatus of claim 1, wherein the first recess is positioned to conduct the one of the plurality of pliable containers in a direction of the first recess and the second recess is configured to conduct another of the plurality of pliable containers in a direction of the second recess.

5. The apparatus of claim 1, wherein the first door further comprises a handle.

6. An apparatus with a plurality of pliable containers, the apparatus comprising: a housing having an external surface, a plurality of sides, and a common container compartment formed therein for receiving at least one of the plurality of pliable containers; a first opening formed between the external surface of the housing and the common container compartment and a first shelf extending from the first opening part way into the common container compartment, wherein the first shelf is configured to partially support one of the plurality of pliable containers near the first opening, wherein the first shelf comprises a first recess formed along one side of the first shelf, wherein the first recess is configured to conduct the one of the plurality of pliable containers in a direction of the first recess; a second opening formed between the external surface of the housing and the common container compartment and a second shelf extending from the second opening part way into the common container compartment, wherein the second shelf is configured to partially support another of the plurality of pliable containers near the second opening, wherein the second shelf comprises a second recess formed along one side of the second shelf, wherein the second recess is configured in a different geometric orientation as compared to the first recess, wherein the second recess is configured to conduct the other of the plurality of pliable containers in the direction of the second recess; wherein the first opening and the second opening are vertically aligned in the housing; a plurality of fasteners, at least one of the plurality of fasteners disposed near one or more of the first opening or the second opening, wherein the plurality of fasteners is configured to removably affix the at least one of the plurality of pliable containers; and further comprising at least one support bar, the support bar positioned between the first shelf and the second shelf and within the common container compartment, wherein a body of the one of the plurality of pliable containers on the first shelf is supported by the support bar.

7. The apparatus of claim 6, wherein one or more of the plurality of fasteners are configured to hold a mouth of the one of the plurality of pliable containers at least partially open.

8. The apparatus of claim 6, further comprising a door hingedly affixed to the housing.

9. An apparatus with a plurality of pliable containers, the apparatus comprising: a housing having an external surface, a plurality of sides, and a common container compartment formed therein for receiving at least one of the plurality of pliable containers; a first opening formed between the external surface of the housing and the common container compartment and a first shelf extending from the first opening part way into the common container compartment, wherein the first shelf is configured to partially support one of the plurality of pliable containers near the first opening, wherein the first shelf comprises a first recess formed along one side of the first shelf extending from the first opening, wherein the first recess is configured to conduct the one of plurality of pliable containers in a direction of the first recess; and a second opening formed between the external surface of the housing and the common container compartment and a second shelf extending from the second opening part way into the common container compartment, wherein the second shelf is configured to partially support another of the plurality of pliable containers near the second opening, wherein the second shelf comprises a second recess formed along one side of the second shelf extending from the second opening, wherein the second recess is configured as a substantially mirror image as compared to the first recess, wherein the second recess is configured to conduct the other of the plurality of pliable containers in the direction of the second recess; wherein the first opening and the second opening are vertically aligned in the recess; and further comprising at least one support bar, the support bar positioned between the first shelf and the second shelf and within the common container compartment, wherein a body of the one of the plurality of pliable containers on the first shelf is supported by the support bar.

10. The apparatus of claim 9, further comprising an odor reducing product.

11. The apparatus of claim 9, further comprising one or more of a can crusher, a tack hook, a topside table, a white board, and a tool hanger.

12. The apparatus of claim 9, further comprising a first door hingedly coupled to the housing and configured to move from a first open position to a closed position, wherein the closed position substantially covers the first opening.

* * * * *